US006613150B1

(12) United States Patent
Calvert et al.

(10) Patent No.: US 6,613,150 B1
(45) Date of Patent: Sep. 2, 2003

(54) MACHINE FOR APPLYING COATINGS TO STRINGERS

(75) Inventors: Gary L. Calvert, Wichita, KS (US); Norman Charles Eggleston, Derby, KS (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/452,787

(22) Filed: Dec. 2, 1999

(51) Int. Cl.[7] ..... B05L 11/02

(52) U.S. Cl. ..... 118/681; 118/680; 118/208; 118/210; 118/239

(58) Field of Search ..... 118/668, 208, 118/210, 259, 112, 680, 681, 206, 239, 244, 252, 256, 261, 677, 262, 410; 156/357, 250, 256, 304.5, 304.6, 535, 558, 578; 198/345.1; 193/35 C; 417/120, 149

(56) References Cited

U.S. PATENT DOCUMENTS

| | | | | |
|---|---|---|---|---|
| 2,925,800 A | * | 2/1960 | Wassem | 118/681 |
| 3,388,020 A | | 6/1968 | Gates | |
| 3,990,937 A | | 11/1976 | Knowles | |
| 4,006,704 A | | 2/1977 | Perondi | |
| 4,295,914 A | | 10/1981 | Checko | |
| 4,302,513 A | | 11/1981 | Russell | |
| 4,314,871 A | | 2/1982 | Weinstock et al. | |
| 4,512,945 A | | 4/1985 | Vigano | |
| 4,632,850 A | | 12/1986 | Tillotson | |
| 4,737,378 A | * | 4/1988 | Narita et al. | 427/8 |
| 4,836,139 A | | 6/1989 | Davies | |
| 4,894,104 A | | 1/1990 | Hemus | |
| 5,332,462 A | | 7/1994 | Myers | |
| 5,348,585 A | * | 9/1994 | Weston | 118/305 |
| 5,415,720 A | | 5/1995 | Schonhammer et al. | |
| 5,479,352 A | * | 12/1995 | Smith | 118/686 |
| 5,628,868 A | | 5/1997 | Marschke et al. | |
| 5,770,267 A | * | 6/1998 | Bullock, Jr. | 427/356 |
| 5,804,019 A | | 9/1998 | Sweet et al. | |

FOREIGN PATENT DOCUMENTS

DE 3710916 A1 * 10/1988 ..... 193/35 C

OTHER PUBLICATIONS

English language translation of DE 3710916 A1, Schulze–Berge, submitted Dec. 20, 2001.*
Brochure: PRC–DeSoto International, Inc., Semco Application Systems, Glendale, California, USA; Dated Feb. 1999; Front Cover, Table of Contents, pp. 4, 5, 10, 15, 18.

* cited by examiner

*Primary Examiner*—Richard Crispino
*Assistant Examiner*—George R. Koch, III
(74) *Attorney, Agent, or Firm*—Alston & Bird LLP

(57) ABSTRACT

A coating machine includes a conveyor surface that receives and carries a stringer toward a downstream end of the conveyor. An engagement mechanism forces the stringer against the conveyor surface. An applicator mechanism coats the stringer with a coating material during a discharge mode. The discharge mode occurs while a stringer within the coating machine is in a predetermined position. A retention mode occurs while there is not a stringer in the predetermined position within the coating machine. A motor drives the conveyor surface at a first speed during the discharge mode, and at a second speed that is slower than the first speed during the retention mode.

14 Claims, 6 Drawing Sheets

MACHINE FOR APPLYING COATINGS TO STRINGERS

FIELD OF THE INVENTION

The present invention pertains to machines for applying coatings and, more particularly, to a machine for applying coatings to stringers.

BACKGROUND OF THE INVENTION

Stringers are generally straight, long, narrow components of the structural skeleton of an aircraft. The stringers are mounted to the interior surface of the skin of the aircraft to reinforce the skin. Whereas some stringers are uniform along their length, other stringers include irregular portions, which are referred to as joggles. The joggles allow the stringers to match irregularities of the skin surface and further allow the stringers to extend over straps that are attached to the skin and extend perpendicular to the stringers.

It is common to apply a coating material, such as a polysulfide sealant, to the surface of a stringer that abuts the skin of the aircraft. The coating protects the aircraft from corrosion. The coating is applied to the stringer prior to mounting the stringer to the skin. As one example, the coating is conventionally initially applied with a pneumatic applicator assembly that is manually moved generally along the length of the stringer. Compressed air is supplied to a chamber of the applicator assembly to force the coating material from a reservoir of the applicator assembly. The coating material is discharged from the reservoir through a nozzle that directs the coating material onto the stringer, so that a long bead of the coating material extends along the length of the stringer. Thereafter, an applicator roller is manually rolled along the length of the stringer to spread the coating material.

Manually applying coatings to the many stringers of an aircraft is very labor intensive. It is desirable to reduce the cost of manufacturing aircraft by reducing labor costs; therefore, manually applying the coating material to stringers is disadvantageous. Further, special care must be taken when manually applying the coating material to ensure that the coating material is well applied, especially in the vicinity of joggles. Depending upon the skill of the operator applying the coating, some of the stringers, or at least the joggles thereof, may not be adequately coated in some situations, which can disadvantageously result in premature corrosion of the aircraft incorporating the stringers.

SUMMARY OF THE INVENTION

The present invention solves the above and other problems by providing a coating machine that automatically applies coatings to the surfaces of stringers. The applied coatings are generally consistent from stringer to stringer and are generally uniform along the length of each stringer, even if the stringers have joggles or different overall dimensions.

In accordance with one aspect of the present invention, a stringer is introduced into an upstream end of the coating machine, and thereafter the stringer is drawn into the coating machine. As the stringer passes through the coating machine, a coating is applied to the surface of stringer that is to abut the skin of an aircraft. Thereafter, the stringer is discharged from the downstream end of the coating machine.

In accordance with another aspect of the present invention, the coating machine includes a conveyor having a conveyor surface that extends in a longitudinal direction from an upstream end of the conveyor to a downstream end of the conveyor. A motor drives the conveyor surface so that the conveyor surface defines a travel path that extends in the longitudinal direction. The conveyor surface sequentially receives and carries stringers toward the downstream end of the conveyor. An applicator mechanism is mounted above the conveyor surface and includes a reservoir containing coating material. The applicator mechanism further includes an actuator for providing a discharge mode and a retention mode. The discharge mode occurs while a stringer within the coating machine is in a predetermined position. A first volumetric flow rate of the coating material is discharged from the reservoir via a nozzle during the discharge mode. The nozzle directs the coating material to an applicator roller. The applicator roller applies the coating material to a stringer while the conveyor surface carries the stringer downstream along the travel path and past the predetermined position. The discharge mode is repeated for each of the stringers that are sequentially processed by the coating machine. The retention mode occurs while there is not a stringer in the predetermined position within the coating machine. Any volumetric flow rate of the coating material that is discharged from the reservoir during the retention mode is substantially less than the first volumetric flow rate.

In accordance with another aspect of the present invention, the applicator roller is movable toward and away from the conveyor surface, and the applicator roller is positioned closer to the conveyor surface during the discharge mode than during the retention mode.

In accordance with another aspect of the present invention, the motor drives the conveyor surface at a first speed during the discharge mode, and at a second speed that is slower than the first speed during the retention mode.

In accordance with another aspect of the present invention, a vacuum is drawn within the chamber of the applicator mechanism during the retention mode. The vacuum within the chamber restricts undesirable dripping of the coating material from the reservoir during the retention mode.

In accordance with another aspect of the present invention, at least one spreading mechanism is positioned downstream from the applicator roller for spreading the coating material applied to the stringer by the applicator mechanism.

In accordance with another aspect of the present invention, at least one alignment mechanism aligns the stringer with the applicator roller.

In accordance with another aspect of the present invention, at least one engagement mechanism forces the stringer against the conveyor surface.

The coating machine of the present invention reduces labor costs associated with aircraft construction by automatically applying coatings to the surfaces of stringers that are to abut the skin of an aircraft. The applied coatings are generally consistent from stringer to stringer and are generally uniform along the length of each stringer, even if the stringers have joggles or are of different sizes, which reduces aircraft corrosion.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

A coating machine 30 (FIG. 2) of the present invention is operative for automatically applying coatings to the surfaces of stringers 20 (FIG. 1) that are to abut the skin of an aircraft. The coating machine 30 is operative so that the applied coatings are generally consistent from stringer 20 to stringer and are generally uniform along the length of each stringer, even if the stringers have irregular portions or have different overall dimensions.

Figure 1:
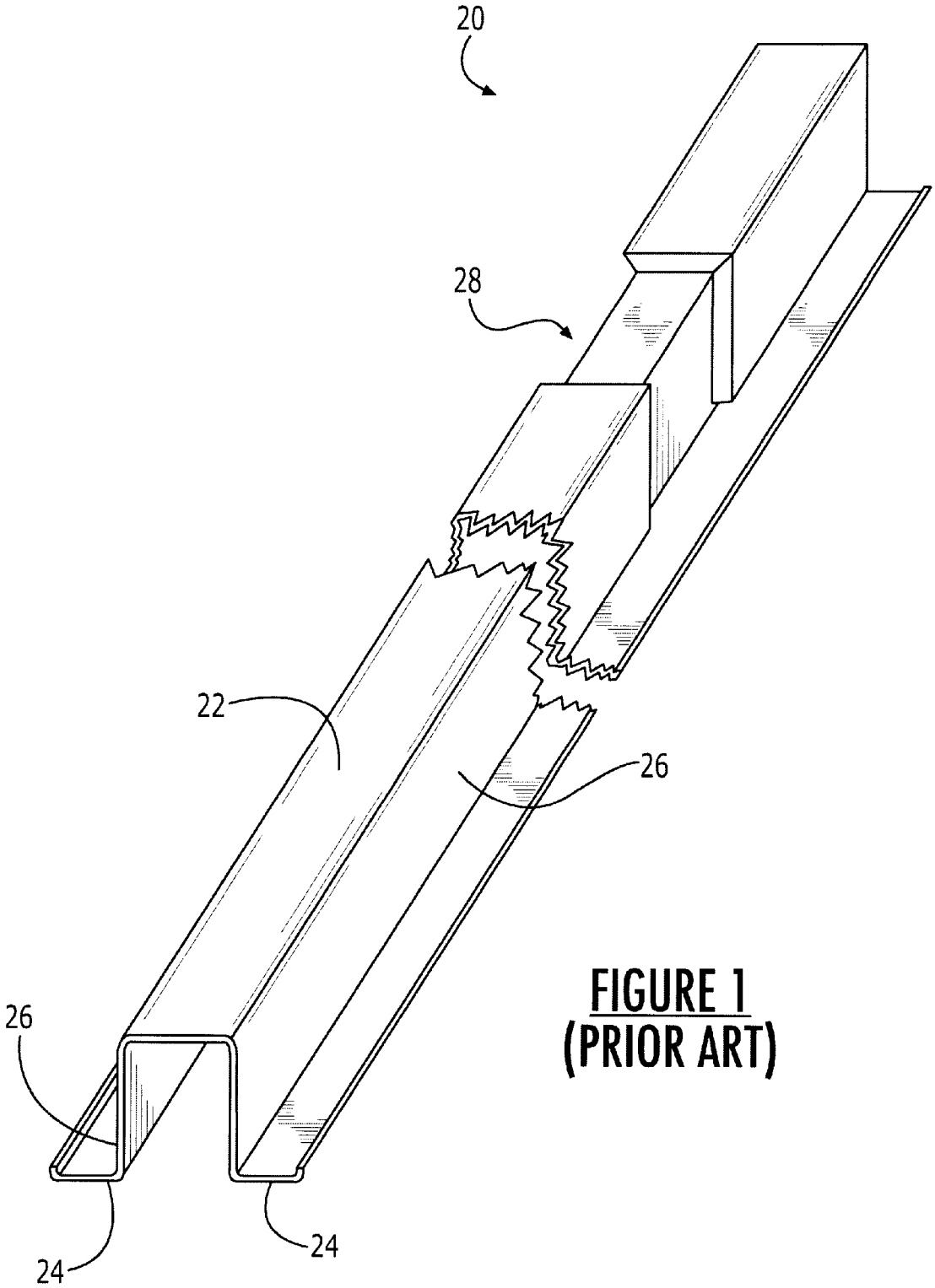
FIGURE 1 (PRIOR ART)
FIG. 1 is a pictorial view of a stringer.

As illustrated in FIG. 1, a stringer 20 includes an upward oriented crown surface 22, a pair of downward oriented brim surfaces 24, and a pair of opposite side surfaces 26, all of which extend along the entire length of the stringer. It is the crown surface 22 of a stringer 20 that is mounted to and abuts the skin of an aircraft. Whereas some stringers 20 are uniform along their entire length, other stringers include one or more irregular portions, which are often referred to as joggles 28. It is common for crown surfaces 22 and side surfaces 26 of stringers 20 to have irregular portions, or joggles 28. Stringers 20 are often approximately twenty-five feet long; however, stringers can be of various lengths. Likewise, it is common for different stringers 20 to have different heights and widths.

Figure 2:
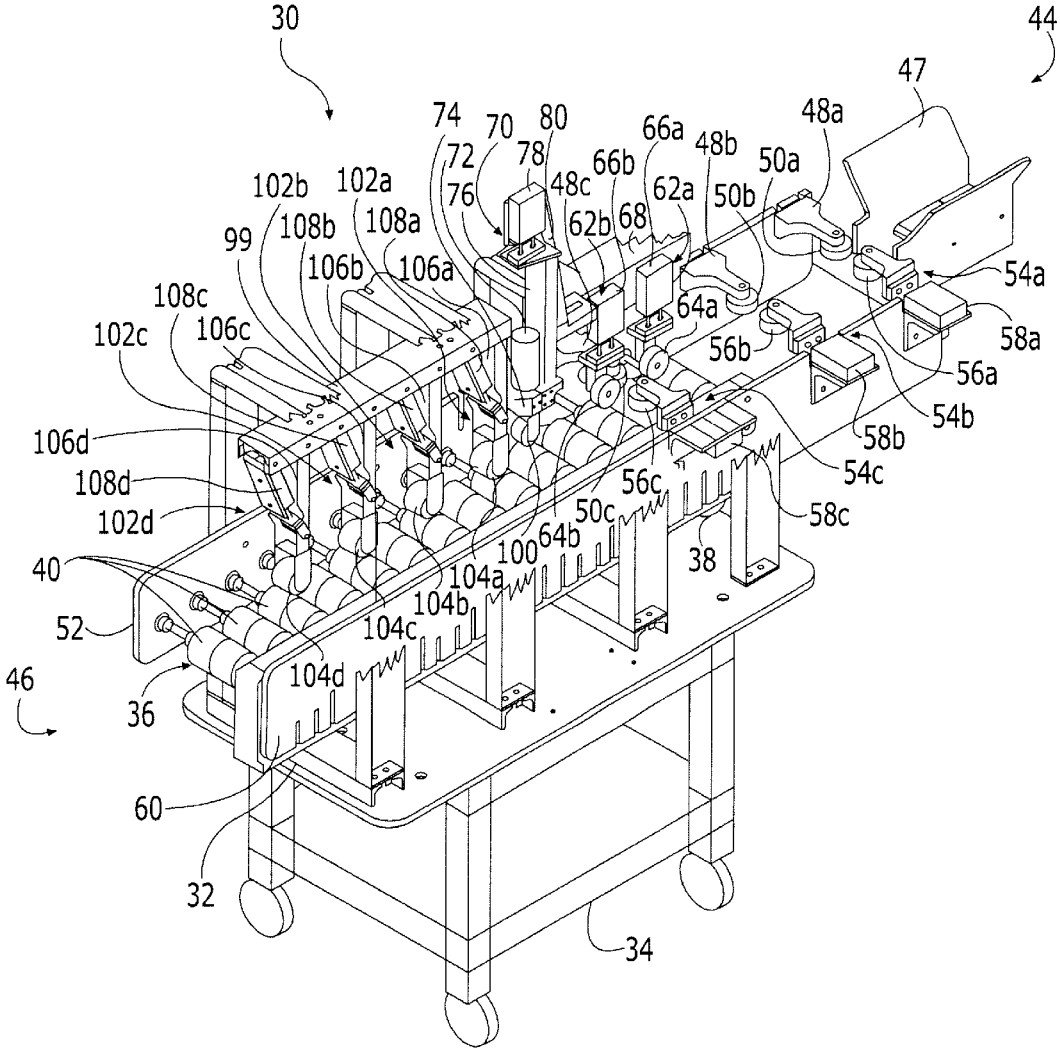
FIG. 2 is a partially schematic, partially cut-away pictorial view of a coating machine that is capable of applying a coating to the stringer of FIG. 1, in accordance with one embodiment of the present invention.

FIG. 2 illustrates a coating machine 30 in accordance with one embodiment of the present invention. The operation of the coating machine 30 will be briefly described, followed by a description of the structures of the coating machine, followed by a more detailed description of the operation of the coating machine. In operation, a stringer 20 (FIG. 1) is introduced into an upstream end 44 of the coating machine 30, and thereafter the stringer is drawn into the coating machine. As the stringer passes through the coating machine 30, a coating material 92 (FIG. 3) is applied to the crown surface 22 (FIG. 1) of the stringer 20. Thereafter, the stringer 20 is discharged from the downstream end 46 of the coating machine 30.

The coating machine 30 includes a frame 32 that is carried by a wheeled base 34. Portions of the frame 32 are cut away in FIG. 2. The frame 32 carries a conveyor 36 having a pneumatic motor-like actuator 38 that drives a series of conveyor rollers 40 (also see FIG. 8) by way of drive chains (not shown) or the like. All of the conveyor rollers 40 rotate in the same direction so that the apexes of the conveyor rollers can be characterized as defining a conveyor surface 42 (FIGS. 4 and 5) that extends in a longitudinal direction. The longitudinal direction extends from the upstream end 44 to the downstream end 46 of the coating machine 30.

In accordance with the illustrated embodiment, a chute or trough-like guide 47 is mounted to the upstream end 44 of the frame 32. The trough-like guide 47 functions to optimally guide a stringer 20 (FIG. 1) into the upstream end 44 of the coating machine 30 when a user of the coating machine is inserting a front end of the stringer 20 into the coating machine. The guide 47 includes walls that at least partially bound a target-like aperture for receiving the front end of the stringer 20. In accordance with an alternative embodiment of the present invention, the trough-like guide 47 is replaced with a vertical plate that is mounted to the upstream end 44 of the frame 32 and defines a target-like aperture for receiving the front end of the stringer 20. In accordance with another alternative embodiment of the present invention, there is no guide 47 mounted to the upstream end 44 of the coating machine 30.

A series of passive alignment mechanisms 48*a–c* are carried by the frame 32 and include abutters that are for abutting one of the side surfaces 26 (FIG. 1) of a stringer 20 (FIG. 1) while the stringer is being processed by the coating machine 30. More specifically, the passive alignment mechanisms 48*a–c* respectively include fixed alignment rollers 50*a–c* that are for abutting one of the side surfaces 26 of a stringer 20 while the stringer is being processed by the coating machine 30. The alignment rollers 50*a–c* are respectively rotatably carried by fixed extensions mounted to a side wall 52 of the frame 32. The alignment rollers 50*a–c* rotate about their respective vertical axes that are carried in fixed relation with respect to the frame 32.

A series of active alignment mechanisms 54*a–c* are carried by the frame 32 and include abutters for abutting one of the side surfaces 26 (FIG. 1) of a stringer 20 (FIG. 1) being processed by the coating machine 30. More specifically, the active alignment mechanisms 54*a–c* respectively include movable alignment rollers 56*a–c* for abutting one of the side surfaces 26 of a stringer 20 being processed by the coating machine 30. The alignment rollers 56*a–c* are respectively rotatably carried by movable extensions. The alignment rollers 56*a–c* are rotatable about their respective vertical axes that are carried in movable relation to a side wall 60 of the frame 32. The active alignment mechanisms 54*a–c* further respectively include pneumatic actuators 58*a–c* that are mounted to the side wall 60 of the frame 32. Push rods of the pneumatic actuators 58*a–c* respectively extend to and carry the extensions that carry the alignment rollers 56*a–c*. The pneumatic actuators 58*a–c* are operative to respectively move the alignment rollers 50*a–c* in a lateral direction, which is generally perpendicular to the longitudinal direction, toward and away from the side wall 52 of the frame 32. The alignment rollers 50*a–c* are moved laterally between retracted and extended configurations, which are discussed in greater detail below.

Engagement mechanisms 62*a,b* are carried by the frame 32 and include abutters for abutting the crown surface 22 (FIG. 1) of a stringer 20 (FIG. 1) that is being processed by the coating machine 30. More specifically, the engagement mechanisms 62*a,b* respectively include engagement rollers 64*a,b* for abutting the crown surface 22 of a stringer 20 that is being processed by the coating machine 30. The engagement rollers 64*a,b* are respectively rotatably carried by movable extensions. The engagement rollers 64*a,b* are rotatable about their respective horizontal axes. The engagement mechanisms 62*a,b* further respectively include pneumatic actuators 66*a,b* that are mounted to an upstream overhead beam 68 of the frame 32. Push rods of the pneumatic actuators 66*a,b* respectively extend to and carry the extensions that respectively carry the engagement rollers 64*a,b*. The pneumatic actuators 66*a,b* are operative to respectively move the engagement rollers 64*a,b* vertically toward and away from the conveyor rollers 40 between retracted and extended configurations, as will be discussed in greater detail below.

An applicator mechanism 70 is carried by the frame 32 and includes a pneumatic applicator assembly 72 that is operative for applying a coating material to the crown surface 22 (FIG. 1) of a stringer 20 (FIG. 1) that is being processed by the coating machine 30. The applicator assembly 72 is removably mounted by a split collar 74 to a carriage 76. The carriage 76 is mounted in movable relation to the frame 32. The applicator mechanism 70 further includes a pneumatic actuator 78 mounted to a mast-like portion 80 of the frame 32. Push rods of the pneumatic actuator 78 extend to the carriage 76. The pneumatic actuator 78 is operative to move the carriage 76, and therefore the applicator assembly 72, vertically toward and away from the conveyor rollers 40 between retracted and extended configurations, as will be discussed in greater detail below.

Figure 3:
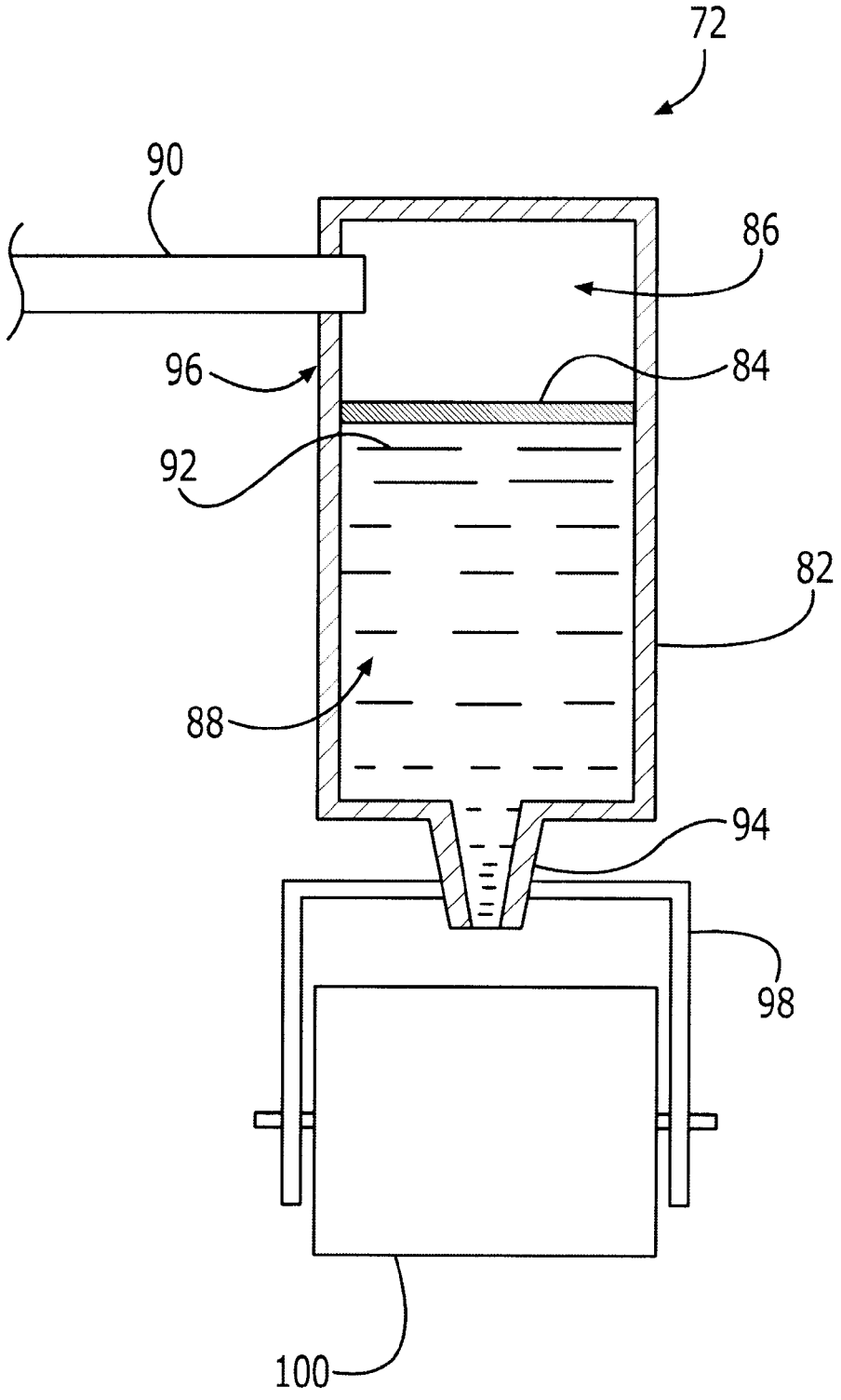
FIG. 3 is a generally isolated, partially schematic, partially cross-sectional view of a pneumatic applicator assembly of the coating machine of FIG. 2.

As best understood with reference to FIG. 3, the applicator assembly 72 includes a canister 82 having an internal chamber that is sectioned by a movable partition 84, which is preferably a piston, diaphragm, or the like, to define a pneumatic chamber 86 and a reservoir 88. A tube 90 defines a passage in communication with the pneumatic chamber 86. A coating material 92, which is preferably a polysulfide sealant, or the like, is contained in the reservoir 88. The canister 82 includes a nozzle 94 that serves as an outlet from the reservoir 88. As will be discussed in greater detail below, the combination of the pneumatic chamber 86 and the movable partition 84 functions as a pneumatic actuator 96 that is operative for forcing the coating material 92 to be discharged from the reservoir 88 through the nozzle 94.

The applicator assembly 72 further includes a bracket 98 mounted to the lower end of the canister 82. The bracket 98 carries an applicator roller 100 that is rotatable about a horizontal axis. The applicator roller 100 is positioned to receive coating material 92 that is discharged from the reservoir 88 through the nozzle 94. The circumferential surface of the applicator roller 100 is operative for spreading coating material 92 carried thereby. The circumferential surface of the applicator roller 100 is preferably defined by a nap-like absorbent material, or the like. The applicator assembly 72 illustrated in FIG. 3 is available from Semco Application Systems of Glendale, Calif.

In accordance with the illustrated embodiment of the present invention, the circumferential surface of the applicator roller 100 spreads coating material 92 carried thereby upon the crown surface 22 (FIG. 1) of the stringer 20 (FIG. 1) while the applicator roller is in contact with the crown surface, as will be discussed in greater detail below. In accordance with an alternative embodiment of the present invention, the nozzle 94 functions as an applicator, meaning that the coating material 92 flows directly from, or is sprayed directly from, the nozzle to the stringer 20 (FIG. 1).

As best understood with reference to FIG. 2, spreading mechanisms 102*a–d* are carried by the frame 32 and include abutters for abutting the crown surface 22 (FIG. 1) of a stringer 20 (FIG. 1) being processed by the coating machine 30. More specifically, the spreading mechanisms 102*a–d* respectively include movable spreading rollers 104*a–d* for abutting the crown surface 22 of a stringer 20 being processed by the coating machine 30. Each of the spreading rollers 104*a–d* is rotatable about a respective horizontal axis and includes a circumferential surface suitable for spreading coating material 92 (FIG. 3) that has previously been applied to the crown surface 22 of a stringer 20 being processed by the coating machine 30. In accordance with one example of the present invention, the spreading rollers 104*a–d* are constructed of a foamed polymeric material, or the like.

The spreading rollers 104*a–d* are respectively rotatably carried by lower ends of pivot arms 106*a–d*. The upper ends of the pivot arms 106*a–d* are respectively pivotably connected to a downstream overhead beam 99 of the frame 32. The spreading mechanisms 102*a–d* further respectively include pneumatic actuators 108*a–d* that are pivotably connected to the downstream overhead beam 99. Push rods of the pneumatic actuators 108*a–d* are respectively pivotably connected to intermediate portions of the pivot arms 106*a–d* so that the pneumatic actuators 108*a–d* are operative to respectively move the spreading rollers 104*a–d* along arcuate paths, which extend generally vertically, between retracted and extended configurations, which are discussed in greater detail below.

Figure 4:
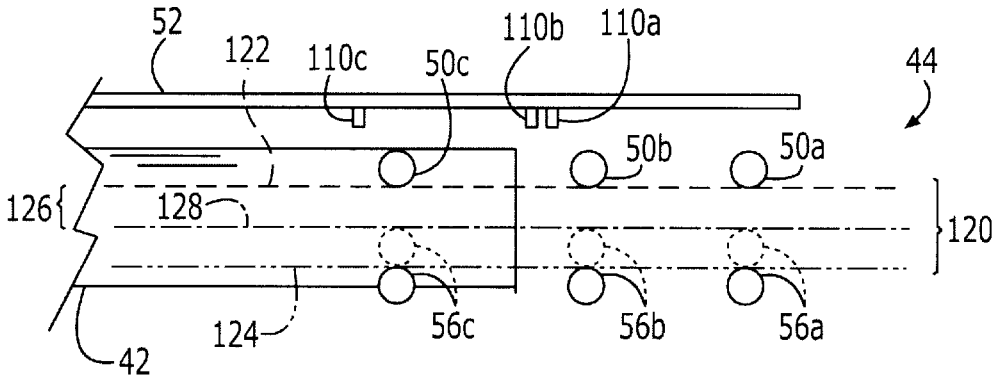
FIG. 4 is a schematic top plan view of selected components of the coating machine of FIG. 2.
Figure 5:
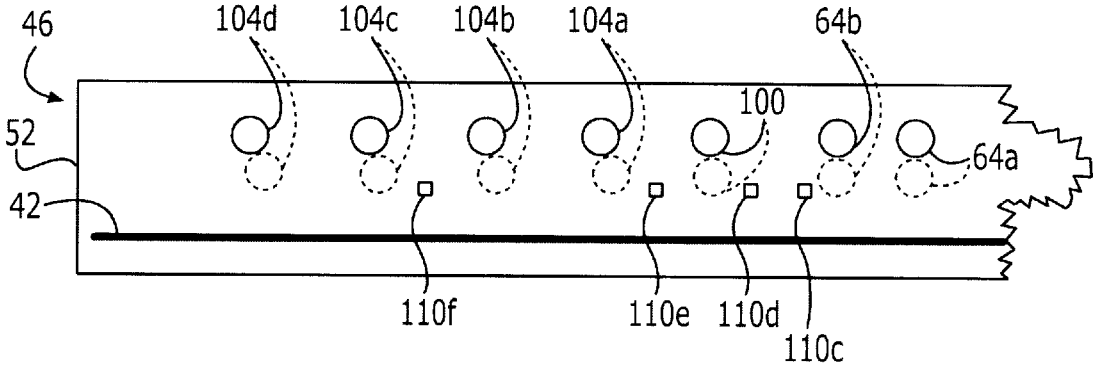
FIG. 5 is a schematic side elevation view of selected components of the coating machine of FIG. 2.

The operations of the pneumatic actuators 38, 58*a–c*, 66*a–b*, 78, 96, 108*a–d* are controlled by a series of pneumatic sensors 110*a–f* (FIGS. 4 and 5). As best understood with reference to FIG. 4, upstream sensors 110*a,b* are in close proximity to one another and are mounted to the side wall 52 of the frame 32 (FIG. 2) at a position that is downstream from and proximate the alignment roller 50*b*. As best understood with reference to FIGS. 4 and 5, a forward midstream sensor 110*c* is mounted to the side wall 52 of the frame 32 at a position that is downstream from and proximate the alignment roller 50*c* and the engagement roller 64*b*. As best understood with reference to FIG. 5, a midstream sensor 110*d* is mounted to the side wall 52 of the frame 32 at a position that is upstream from and proximate the applicator roller 100. A rearward midstream sensor 110*e* is mounted to the side wall 52 of the frame 32 at a position that is upstream from and proximate the spreading roller 104*a*. A downstream sensor 110*f* is mounted to the side wall 52 of the frame 32 at a position that is upstream from and proximate the spreading roller 104*c*. Each of the sensors 110*a–f* is mounted to the side wall 52 of the frame at respective positions that are proximate the conveyor surface 42 and at an elevation above the conveyor surface.

Figure 6:
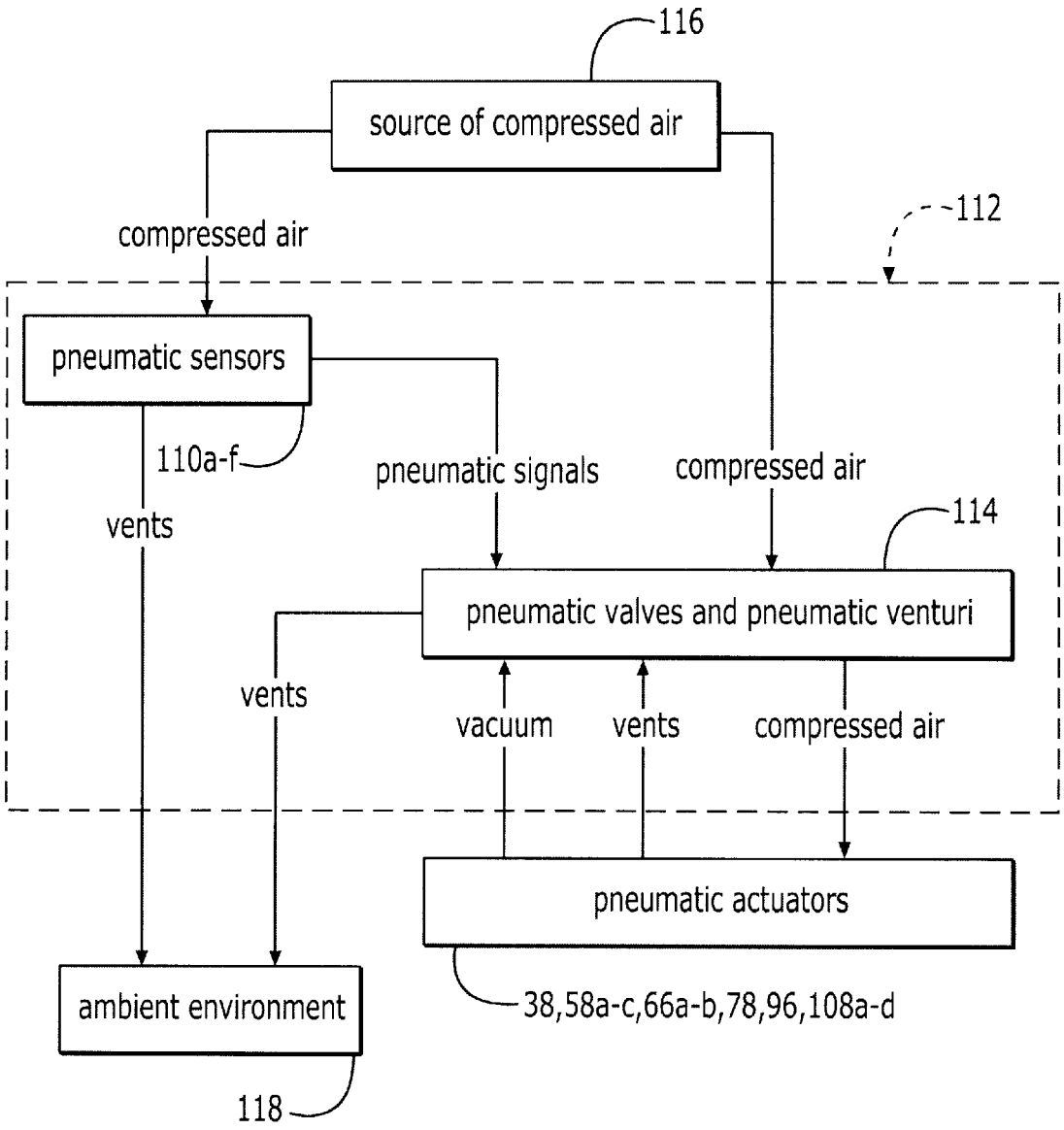
FIG. 6 diagrammatically illustrates a pneumatic control system of the coating machine of FIG. 2.

FIG. 6 diagrammatically illustrates a pneumatic control system 112 of the coating machine 30 (FIG. 2), in accordance with one embodiment of the present invention. In addition to including the sensors 110*a–f* (also see FIGS. 4 and 5), the pneumatic control system 112 further includes multiple pneumatic operators 114. In accordance with the illustrated embodiment of the present invention, the pneumatic operators 114 include, but are not limited to, pneumatic valves and a pneumatic venturi, or the like. Whereas the pneumatic sensors 110*a–f* and pneumatic operators 114 are illustrated in a collective fashion in FIG. 6, those of ordinary skill in the art will appreciate that the pneumatic control system 112 can be characterized as including multiple different controllers, and that the operations of each of the pneumatic actuators 38, 58*a–c*, 66*a–b*, 78, 96, 108*a–d*

(also see FIG. 2) is controlled by one or more of the controllers of the pneumatic control system 112. In accordance with the illustrated embodiment of the present invention, a controller is by definition one the components of, or a group of the components of, the control system 112.

The pneumatic control system 112 utilizes compressed air from a source of compressed air 116, or the like, to operate the pneumatic actuators 38, 58*a–c*, 66*a–b*, 78, 96, 108*a–d*. More specifically, in accordance with one embodiment of the present invention, compressed air from the source of compressed air 116 is supplied to the pneumatic sensors 110*a–f* by way of multiple respective tubes, and to the pneumatic operators 114 by way of multiple respective tubes. Each of the pneumatic sensors 110*a–f* includes a body defining a vent path and carrying a long appendage (not shown) that is biased to extend in a reference direction, or the like. When the appendage of a sensor 110*a–f* is moved, such as due to being contacted by a stringer 20 (FIG. 1), compressed air that is supplied to that sensor is vented via the vent of that sensor to the ambient environment 118. One or more respective pneumatic operators 114 are responsive to the venting of compressed air from one or more of the sensors 110*a–f*, such that a venting sensor can be characterized as providing a pneumatic signal to one or more of its respective pneumatic operators. In response to respectively receiving one or more of the pneumatic signals, each pneumatic operator 114 performs its respective one or more operations.

In accordance with one embodiment of the present invention, each pneumatic operator 114 communicates with one or more of its respective pneumatic actuators 38, 58*a–c*, 66*a–b*, 78, 96, 108*a–d* by way of one or more respective tubes. The operations of the pneumatic operators 114 include supplying compressed air, supplying vent paths to the ambient environment 118, and supplying vacuum to a respective one or more of the pneumatic operators 38, 58*a–c*, 66*a–b*, 78, 96, 108*a–d*.

Those of ordinary skill in the art will appreciate that various and differently configured pneumatic controllers, and the like, can be utilized to control the operations of the pneumatic actuators 38, 58*a–c*, 66*a–b*, 78, 96, 108*a–d* to carry out the above and below described operations of the illustrated embodiment of the present invention. For example, in accordance with one embodiment of the present invention, the control system 112 functions to vary the speed at which the motor-like actuator 38 (FIG. 2) operates, which varies the rotational speed of the conveyor rollers 40 (FIG. 2) and thereby the speed at which a stringer 20 (FIG. 1) is conveyed through the coating machine 30. The operational speed of the motor-like actuator 38 is preferably varied by changing the discharge vent path of the motor-like actuator. That is, a relatively restrictive discharge vent path is provided for the motor-like actuator 38 so that the motor-like actuator is caused to operate at a relatively low speed during one mode of operation. A relatively less restrictive discharge vent path is provided for the motor-like actuator 38 so that the motor-like actuator is caused to operate at a relatively high speed during another mode of operation.

In accordance with one embodiment of the present invention, each of the pneumatic actuators 58*a–c*, 66*a–b*, 78, 108*a–d* are double-actuated pneumatic cylinders. A representative one of those pneumatic actuators will now be described, in accordance with one embodiment of the present invention. The representative pneumatic cylinder includes a piston (not shown) that separates the cylinder's chamber (not shown) into two chamber portions (not shown). Push rods extend from one side of the piston, through one of the chamber portions, and out one of the ends of the cylinder. Both of the chamber portions of the pneumatic cylinder are charged with compressed air from the source of compressed air 116 (FIG. 6) to provide an extended configuration. The push rods are extended from the pneumatic cylinder during the extended configuration. The extended configuration is achieved with both of the chambers charged because the piston has a larger active surface area on the side of the piston that is opposite from the push rods. The push rods are in a retracted configuration while the chamber portion through which the push rods extend is charged with compressed air from the source of compressed air 116 and the other chamber portion is vented to the atmosphere 118 (FIG. 6).

As best understood with reference to FIG. 3, the pneumatic actuator 96 of the applicator assembly 72 is in a discharge mode while compressed air from the source of compressed air 116 (FIG. 6) is supplied to the pneumatic chamber 86. A first volumetric flow rate of the coating material 92 is discharged from the reservoir 88 through the nozzle 94 during the discharge mode. The applicator assembly 72 is designed and operated so that the first volumetric flow rate is sufficient for applying an optimal coating of the coating material 92 to the stringer 20 (FIG. 1). Those of ordinary skill in the art should know the desired characteristics of such an optimal coating. In accordance with one embodiment of the present invention, the pneumatic chamber 86 is vented to the ambient environment 118 (FIG. 6) during a retention mode. As a result, any volumetric flow rate of the coating material 92 through the nozzle 94 during the retention mode is substantially less than the volumetric flow rate of the coating material through the nozzle during the discharge mode.

In accordance with a more preferred embodiment of the present invention, one or more of the pneumatic operators 114 (FIG. 6) function so that a vacuum is created in the pneumatic chamber 86 during the retention mode. As a result, any volumetric flow rate of the coating material 92 through the nozzle 94 during the retention mode is substantially less than the volumetric flow rate of the coating material through the nozzle during the discharge mode. Creating a vacuum in the pneumatic chamber 86 seeks to create a vacuum in the reservoir 88, so that the coating material 92 is restricted from dripping out of the nozzle 94 during the retention mode. In accordance with one embodiment of the present invention, the vacuum in the pneumatic chamber 86 is facilitated through the use of a pneumatic operator 114 that is in the form of a pneumatic venturi, or the like. The use of a pneumatic venturi to create a vacuum should be understood by those of ordinary skill in the art. In accordance with an alternative embodiment of the present invention, a vacuum pump, or the like, is used to create the vacuum in the pneumatic chamber 86.

FIGS. 4 and 5 respectively illustrate the retracted and extended configurations of the alignment mechanisms 48*a–c*; 54*a–c* (FIG. 2) and the remaining active mechanisms 62*a,b*; 70; 102*a–d* (FIG. 2) by illustrating the positions of their respective rollers 56*a–c* and 64*a–b*, 100, 104*a–d* in their retracted and extended configurations. The positions of the rollers 56*a–c*, 64*a–b*, 100, 104*a–d* in their retracted configurations are illustrated by solid lines, whereas the positions of those rollers in their extended configurations are illustrated by solid lines.

As best understood with reference to FIG. 4, the conveyor surface 42 defines a relatively wide travel path 120 that extends in the longitudinal direction. The wide travel path 120 is at least partially defined by the alignment rollers

56*a–c* of the active alignment mechanisms 54*a–c* while they are in their retracted configurations. More specifically, the width of the wide travel path 120 is defined between the passive alignment rollers 50*a–c* and the active alignment rollers 56*a–c* while in their retracted configurations. For illustrative purposes, the opposite sides of the wide travel path 120 are illustrated by a boundary line 122 represented by generally uniform dashed lines and a boundary line 124 represented by a series of three short dashes alternating with one long dash.

The active alignment rollers 56*a–c* extend into the wide travel path 120 during their extended configurations so that a relatively narrow travel path 126 is defined. The narrow travel path 126 is narrower than the wide travel path 120, extends in the longitudinal direction, and is a subset of the wide travel path. More specifically, the width of the narrow travel path 126 is defined between the passive alignment rollers 50*a–c* and the active alignment rollers 54*a–c* during their extend configurations. For illustrative purposes, the opposite sides of the narrow travel path 126 are illustrated by the boundary line 122 represented by generally uniform dashed lines and a boundary line 128 represented by a series of two short dashes alternating with one long dash.

As best understood with reference to FIGS. 1–6, the following Table 1 discloses Operational States 1–10 of the coating machine 30, in accordance with one embodiment of the present invention. The Operational States 1–10 are at least partially described in the context of a stringer 20 carried by the conveyor 36 from the upstream end 44 to the downstream end 46 of the coating machine 30. For each of the Operational States 1–10, a predetermined position of the stringer 20 with respect to the coating machine 30 is specified, the state of the sensor(s) 110*a–f* positioned for monitoring that predetermined position is specified, and the configuration(s) of the respective mechanism(s) 54*a–c*, 62*a–b*, 70, 102*a–d* that are achieved in response to the triggering of the respective sensor(s) are specified.

TABLE 1

Operational States

| No. | Positions of Stringer | States of Sensors | Positions of Mechanisms |
|---|---|---|---|
| 1 | stringer 20 is distant from upstream alignment mechanisms 54a, b | neither of upstream sensors 110a, b are triggered | Upstream alignment mechanisms 54a, b are in their retracted configurations |
| 2 | stringer 20 is distant from engagement mechanism 62a, b and distant from downstream alignment mechanism 54c | forward midstream sensor 110c is not triggered | Engagement mechanisms 62a, b and downstream alignment mechanism 54c are in their retracted configurations |
| 3 | stringer 20 is distant from applicator mechanism 70 | midstream sensor 110d is not triggered | Applicator mechanism 70 is in its retracted configuration, a vacuum is provided in pneumatic chamber 86, and conveyor 36 is operated at a relatively low speed so that any stringer 20 carried by the conveyor surface 42 is carried downstream at a relatively slow speed |
| 4 | stringer 20 is distant from upstream spreading mechanisms 102a, b | rearward midstream sensor 110e is not triggered | Upstream spreading mechanisms 102a, b are in their retracted configurations |
| 5 | stringer 20 is distant from downstream spreading mechanisms 102c, d | downstream sensor 110f is not triggered | downstream spreading mechanisms 102c, d are in their retracted configurations |
| 6 | stringer 20 is in predetermined position proximate upstream alignment mechanisms 54a, b | at least one of or either of the upstream sensors 110a, b are triggered | upstream alignment mechanisms 54a, b are in their extended configurations to cause the stringer 20 to travel along the narrow travel path 126 |
| 7 | stringer 20 is in predetermined position proximate engagement mechanisms 62a, b and proximate downstream alignment mechanism 54c | forward midstream sensor 110c is triggered | engagement mechanisms 62a, b are in their extended configurations to force the stringer 20 against the conveyor surface 42, and downstream alignment mechanism 54c is in its extended configuration to cause the stringer 20 to travel along the narrow travel path 126 |
| 8 | stringer 20 is in predetermined position proximate applicator mechanism 70 | midstream sensor 110d is triggered | applicator mechanism 70 is in its extended configuration, applicator assembly 72 is operated to apply coating material 92 to the crown surface 22 of the stringer 20, and conveyor 36 is operated at a relatively high speed so that the |

TABLE 1-continued

| Operational States | | | |
|---|---|---|---|
| No. | Positions of Stringer | States of Sensors | Positions of Mechanisms |
| | | | stringer carried by the conveyor surface is carried downstream at a relatively high speed |
| 9 | stringer 20 is in predetermined position proximate upstream spreading mechanisms 102a, b | rearward midstream sensor 110e is triggered | upstream spreading mechanisms 102a, b are in their extended configurations to spread coating material 92 previously applied to the crown surface 22 of the stringer 20 |
| 10 | stringer 20 is in predetermined position proximate downstream spreading mechanisms 102c, d | downstream sensor 110f is triggered | downstream spreading mechanisms 102c, d are in their extended configurations to spread coating material 92 previously applied to the crown surface 22 of the stringer 20 |

The overall operation of the coating machine 30 will now be described, in accordance with one embodiment of the present invention. The overall operation of the coating machine 30 is best understood with reference to FIGS. 1–6 and Table 1. The coating machine 30 operates upon a stringer 20 that is longer than the coating machine. Briefly described, a user of the coating machine 30 manually introduces a stringer 20 into the upstream end 44 of the coating machine. Thereafter, the user releases the stringer 20 and walks to the downstream end 46 of the coating machine 30 and receives the stringer 20 that he or she just introduced to the coating machine and that is being ejected from the downstream end 46 of the coating machine. The ejected stringer 20 has a coating of the coating material 92 upon the crown surface 22 thereof.

More specifically, the coating machine 30 operates in accordance with a First Multi-State Mode of Operation while the coating machine is not processing a stringer 20. In response to a stringer 20 being properly introduced to the coating machine 30, the coating machine sequentially operates in accordance with Second through Tenth Multi-State Modes of Operation. The series of Multi-State Modes of Operation is repeated for each of the stringers that are serially introduced to the coating machine 30. The First through Tenth Multi-State Modes of Operation are discussed in greater detail below, in accordance with one embodiment of the present invention.

First Multi-State Mode of Operation

The coating machine 30 operates concurrently in accordance with Operational States 1–5 during the First Multi-State Mode of Operation. A front end of the stringer 20 is manually introduced into the upstream end 44 of the coating machine 10 during the First Multi-State Mode of Operation. The front end of the stringer 20 is manually moved into the coating machine 30 along the wide travel path 120, with the crown surface 22 oriented upward and the brim surfaces 24 oriented downward. The front end of the stringer 20 is introduced to the coating machine 30 through the guide 47, or the like, mounted to the upstream end 44 of the frame 32. The guide 47 includes walls that at least partially bound the wide travel path 120 and define a target-like aperture for receiving the front end of the stringer 20. Thereafter, the front end of the stringer 20 is manually moved along the wide travel path 120 so that the front end of the stringer 20 moves toward one or both of the appendages of the upstream sensors 110*a,b*. The two upstream sensors 110*a,b* are provided and are slightly displaced from one another to define a broad zone for detecting the movement of the front end of the stringer 20 into the coating machine 30. The redundant nature of the two upstream sensors 110*a,b* compensates for inconsistencies in the manner in which users introduce the ends of stringers 20 into the coating machine 30.

Second Multi-State Mode of Operation

The coating machine 30 operates concurrently in accordance with Operational States 2–6 during the Second Multi-State Mode of Operation. The transition from the First to the Second Operational Mode of Operation occurs when the front end of the stringer 20 being manually introduced into the coating machine 30 triggers of one or both of the upstream sensors 110*a,b*. Operational State 6 occurs rather than Operational State 1 so long as a side surface 26 of the stringer 20 is adjacent and thereby triggering at least one of the upstream sensors 110*a,b*.

As should be apparent from the foregoing or in addition to that which should be apparent from the forgoing, the following occurs during the Second Multi-State Mode of Operation: First, the stringer 20 continues to be manually inserted farther into the coating machine 30 along the narrow travel path 126, and eventually the front end of the stringer reaches the upstream end of the conveyor 36. Thereafter, the conveyor 36 draws the stringer 20 further into the coating machine 30 along the narrow travel path 126. As the conveyor 36 draws the stringer 20 further into the coating machine 30 along the narrow travel path 126, the stringer travels toward the appendage of the forward midstream sensor 110*c*.

Third Multi-State Mode of Operation

The coating machine 30 operates concurrently in accordance with Operational States 3–7 during the Third Multi-State Mode of Operation. The transition from the Second to the Third Multi-State Mode of Operation occurs in response to the front end of the stringer 20 triggering the forward midstream sensor 110*c*. Operational State 7 occurs rather than Operational State 2 so long as a side surface 26 of the stringer 20 is adjacent and thereby triggering the forward midstream sensor 110*c*. As should be apparent from the foregoing or in addition to that which should be apparent from the forgoing, the conveyor 36 carries the stringer 20 along the narrow travel path 126 toward the appendage of the midstream sponsor 110*d* during the Third Multi-State Mode of Operation.

Fourth Multi-State Mode of Operation

The coating machine 30 operates concurrently in accordance with Operational States 4–8 during the Fourth Multi-State Mode of Operation. The transition from the Third to the Fourth Multi-State Mode of Operation occurs in response to the front end of the stringer 20 triggering the midstream sensor 110*d*. Operational State 8 occurs rather than Operational State 3 so long as a side surface 26 of the stringer 20 is adjacent and thereby triggering the midstream sensor 110*d*. As should be apparent from the foregoing or in addition to that which should be apparent from the forgoing, the conveyor 36 carries the stringer 20 along the narrow travel path 126 toward the appendage of the rearward midstream sensor 110*e* during the Fourth Multi-State Mode of Operation.

Fifth Multi-State Mode of Operation

The coating machine 30 operates concurrently in accordance with Operational States 5–9 during the Fifth Multi-State Mode of Operation. The transition from the Fourth to the Fifth Multi-State Mode of Operation occurs in response to the front end of the stringer 20 triggering the rearward midstream sensor 110*e*. Operational State 9 occurs rather than Operational State 4 so long as a side surface 26 of the stringer 20 is adjacent and thereby triggering the rearward midstream sensor 110*e*. As should be apparent from the foregoing or in addition to that which should be apparent from the forgoing, the conveyor 36 carries the stringer 20 along the narrow travel path 126 toward the appendage of the downstream sensor 110*f* during the Fifth Multi-State Mode of Operation.

Sixth Multi-State Mode of Operation

The coating machine 30 operates concurrently in accordance with Operational States 6–10 during the Sixth Multi-State Mode of Operation. The transition from the Fifth to the Sixth Multi-State Mode of Operation occurs in response to the front end of the stringer 20 triggering the downstream sensor 110*f*. Operational State 10 occurs rather than Operational State 5 so long as a side surface 26 of the stringer 20 is adjacent and thereby triggering the downstream sensor 110*f*. As should be apparent from the foregoing or in addition to that which should be apparent from the forgoing, the conveyor 36 carries the stringer 20 downstream along the narrow travel path 126 during the Sixth Multi-State Mode of Operation.

Seventh Multi-State Mode of Operation

The coating machine 30 operates concurrently in accordance with Operational States 1 and Operational States 7–10 during the Seventh Multi-State Mode of Operation. The transition from the Sixth to the Seventh Multi-State Mode of Operation occurs in response to the rear end of the stringer 20 passing the upstream sensors 110*a,b*. Operational State 1 occurs rather than Operational State 6 so long as neither of the upstream sensors 110*a,b* are triggered by the stringer 20. As should be apparent from the foregoing or in addition to that which should be apparent from the forgoing, the conveyor 36 carries the stringer 20 farther downstream along the narrow travel path 126 during the Seventh Multi-State Mode of Operation.

Eighth Multi-State Mode of Operation

The coating machine 30 operates concurrently in accordance with Operational States 1–2 and Operational States 8–10 during the Eighth Multi-State Mode of Operation. The transition from the Seventh to the Eighth Multi-State Mode of Operation occurs in response to the rear end of the stringer 20 passing the forward midstream sensor 110*c*. Operational State 2 occurs rather than Operational State 7 so long as the forward midstream sensor 110*c* is not triggered by the stringer 20. As should be apparent from the foregoing or in addition to that which should be apparent the narrow travel path 126 during the Eighth Multi-State Mode of Operation.

Ninth Multi-State Mode of Operation

The coating machine 30 operates concurrently in accordance with Operational States 1–3 and Operational States 9–10 during the Ninth Multi-State Mode of Operation. The transition from the Eighth to the Ninth Multi-State Mode of Operation occurs in response to the rear end of the stringer 20 passing the midstream sensor 110*d*. Operational State 3 occurs rather than Operational State 8 so long as the midstream sensor 110*d* is not triggered by the stringer 20. As should be apparent from the foregoing or in addition to that which should be apparent from the forgoing, the conveyor 36 carries the stringer 20 farther downstream along the narrow travel path 126 during the Ninth Multi-State Mode of Operation.

Tenth Multi-State Mode of Operation

The coating machine 30 operates concurrently in accordance with Operational States 1–4 and Operational State 10 during the Tenth Multi-State Mode of Operation. The transition from the Ninth to the Tenth Multi-State Mode of Operation occurs in response to the rear end of the stringer 20 passing the midstream sensor 110*e*. Operational State 4 occurs rather than Operational State 9 so long as the midstream sensor 110*e* is not triggered by the stringer 20. As should be apparent from the foregoing or in addition to that which should be apparent from the forgoing, the conveyor 36 carries the stringer farther downstream along the narrow travel path 126 during the Tenth Multi-State Mode of Operation.

The transition from the Tenth to the First Multi-State Mode of Operation occurs in response to the rear end of the stringer 20 passing the downstream sensor 110*f*. Operational State 5 occurs rather than Operational State 10 so long as the downstream sensor 110*f* is not triggered by the stringer. The conveyor 36 ejects the rear end of the stringer 20 from the rear end 46 of the coating machine 30 shortly after the rear end of the stringer 20 passes the downstream sensor 110*f*.

Figure 7:
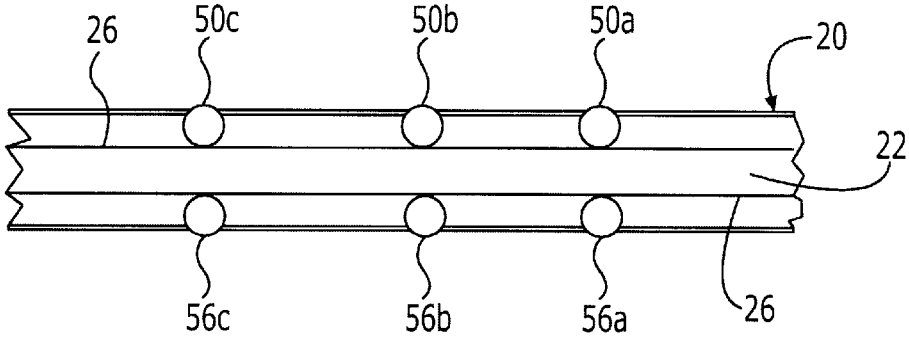
FIG. 7 is a schematic top plan view of selected components of the coating machine of FIG. 2 operating upon the stringer of FIG. 1, in accordance with one embodiment of the present invention.

FIG. 7 is a schematic top plan view illustrating the interaction between the passive alignment rollers 50*a–c*, active alignment rollers 54*a–c*, and a stringer 20 during the Third through Sixth Multi-State Modes of Operation. The alignment rollers 50*a–c* and 56*a–c* are respectively engaged to and in rolling contact with the opposite sides 26 of the stringer 20 being processed by the coating machine 30 during the Third through Sixth Multi-State Modes of Operation. It is preferred for the active alignment rollers 56*a–c* to be close to but not in their fully actuated configurations while interacting with a stringer 20 in the manner illustrated in FIG. 7. As a result, the active alignment rollers 56*a–c* are able to automatically move farther toward the passive alignment rollers 50*a–c* upon encountering a joggle 28, or the like. As a result, optimal contact is maintained between the active alignment rollers 56*a–c* and the stringer 20 being processed by the coating machine 30, at least during the Third through Sixth Multi-State Modes of Operation.

Figure 8:
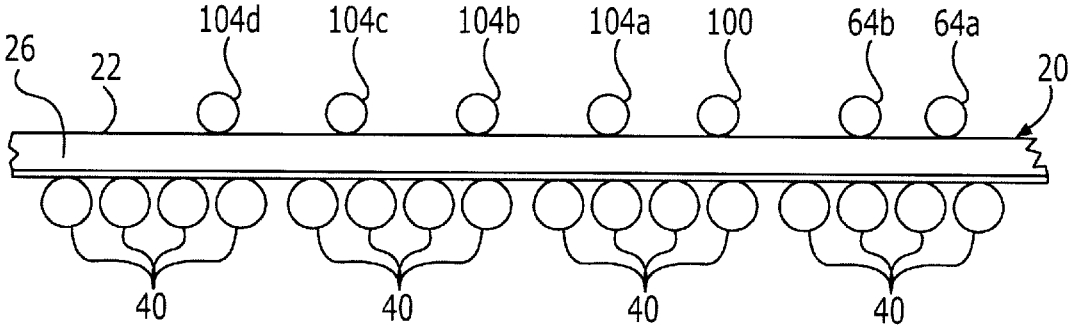
FIG. 8 is a schematic side elevation view of selected components of the coating machine of FIG. 2 operating upon the stringer of FIG. 1, in accordance with one embodiment of the present invention.

FIG. 8 is a schematic side elevation view illustrating the interaction between the conveyor rollers 40, engagement rollers 64*a–b*, applicator roller 100, spreading rollers 104*a–d*, and a stringer 20 during the Seventh through Tenth Multi-State Modes of Operation. At least some of the conveyor rollers 40, and the engagement rollers 64*a–b*, applicator roller 100, and spreading rollers 104a-d are respectively engaged to and in rolling contact with the brim surfaces 24 and the crown surface 22 of the stringer 20 being processed by the coating machine 30 during the Seventh through Tenth Multi-State Modes of Operation. It is preferred for the engagement rollers 64*a–b*, applicator roller 100, and spreading rollers 104*a–d* to be close to but not in their fully actuated configurations while interacting with a stringer 20 in the manner illustrated in FIG. 8. As a result, the engagement rollers 64*a,b*, applicator roller 100, and spreading rollers 104*a,b* are able to automatically move farther toward the conveyor rollers 40 upon encountering a joggle 28, or the like. As a result, optimal contact is maintained between the engagement rollers 64*a,b*, applicator roller 100, spreading rollers 104*a,b*, and stringer 20 being processed by the coating machine 30, at least during the Seventh through Tenth Multi-State Modes of Operation.

Advantageously, the coating machine 30 of the present invention is operative for automatically applying coating material 92 to the crown surfaces 22 of stringers 20. The coating machine 30 is operative so that the coating material 92 is applied to multiple stringers 20 in a manner that is generally consistent from stringer to stringer, and in a manner that is generally uniform along the length of each stringer, even if the stringers have joggles 28, or the like, or have different overall dimensions.

Whereas the present invention has been described in the context of pneumatic controllers and actuators, those of ordinary skill in the art will appreciate that it is within the scope of the present invention for the coating machine 30 to incorporate different types of and/or arrangements of controllers and actuators.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A coating machine for applying a coating material to a stringer, the coating machine comprising:

a conveyor comprising:

conveyor surface that extends in a longitudinal direction from an upstream end of the conveyor to a downstream end of the conveyor, and a motor capable of driving the conveyor surface so that the conveyor surface defines a relatively wide travel path that extends in the longitudinal direction and the conveyor surface is capable of receiving and carrying the stringer toward the downstream end of the conveyor;

a first alignment mechanism comprising a first alignment abutter capable of abutting a side of the stringer while the stringer is carried toward the downstream end of the conveyor by the conveyor surface;

a second alignment mechanism comprising:

a second alignment abutter capable of abutting a side of the stringer while the stringer is carried toward the downstream end of the conveyor by the conveyor surface, wherein the first and second alignment abutters are positioned on opposite sides of the wide travel path, and the second alignment abutter is movable between:

a retracted configuration, and an extended configuration in which the second alignment abutter extends into the wide travel path so that a relatively narrow travel path is defined, wherein the narrow travel path has a width that is defined between the first and second alignment abutters while the second alignment abutter is in the extended configuration so that the narrow travel path is narrower than the wide travel path, the narrow travel path extends in the longitudinal direction, and the conveyor surface is capable of carrying the stringer downstream along the narrow travel path while the second alignment abutter is in its extended configuration, and an actuator operative for moving the second alignment abutter generally laterally between the second alignment abutter's retracted and extended configurations; and an applicator mechanism capable of applying the coating material to the stringer while the conveyor surface carries the stringer toward the downstream end of the conveyor along the narrow travel path.

2. A coating machine for applying a coating material to a stringer according to claim 1, further comprising a guide positioned upstream from the first and second alignment abutters, wherein the guide comprises structure that at least partially extends around the wide travel path and defines a target-like aperture for receiving an end of the stringer that is initially introduced to the coating machine.

3. A coating machine for applying a coating material to a stringer according to claim 1, wherein the narrow travel path is a subset of the wide travel path.

4. A coating machine for applying a coating material to a stringer according to claim 1, wherein the applicator mechanism comprises an applicator positioned downstream from the alignment mechanism, a reservoir capable of containing the coating material, and an actuator operative for discharging the coating material from the reservoir so that the applicator is capable of applying the coating material to the stringer while the conveyor surface carries the stringer downstream along the narrow travel path.

5. A coating machine for applying a coating material to a stringer according to claim 1, further comprising a controller operative for determining if the stringer is in a position proximate the second alignment abutter, wherein the actuator of the second alignment mechanism is responsive to the controller to:

move the second alignment abutter to its retracted configuration while the stringer is remote from the second alignment mechanism, and move the second alignment abutter to its extended configuration while the stringer is in the position proximate the second alignment abutter.

6. A coating machine for applying a coating material to a stringer according to claim 1, wherein the applicator mechanism comprises:

an applicator, a reservoir capable of containing the coating material, and an actuator operative for discharging the coating material from the reservoir so that the applicator is capable of applying the coating material to a side of the stringer that is generally opposite from the conveyor surface while the stringer is carried along the narrow travel path by the conveyor surface.

7. A coating machine for applying a coating material to a stringer according to claim 6, further comprising:

an spreading mechanism positioned downstream from the applicator and comprising:

a spreading abutter movable between:

an extended configuration, wherein during the extended configuration the spreading abutter is positioned proximate the narrow travel path and a first distance from the conveyor surface, and wherein during the extended configuration the spreading abutter is capable of abutting the side of the stringer that is generally opposite from the conveyor surface to spread the coating material while the stringer is carried along the narrow travel path by the conveyor surface, and a retracted configuration in which the spreading abutter is positioned a second distance from the conveyor surface that is greater than the first distance, and an actuator operative for moving the spreading abutter between the spreading abutter's extended and retracted configurations; and a controller operative for determining if the stringer is in a position proximate the spreading abutter, wherein the actuator of the spreading mechanism is responsive to the controller to:

move the spreading abutter to its retracted configuration while the stringer is remote from the spreading abutter, and move the spreading abutter to its extended configuration while the stringer is proximate the spreading abutter.

8. A coating machine for applying a coating material to a stringer according to claim 1, further comprising:

an engagement mechanism comprising:

an engagement abutter positioned proximate the narrow travel path and movable between:

an extended configuration, wherein the engagement abutter is positioned a first distance from the conveyor surface and is capable of abutting a side of the stringer that is generally opposite from the conveyor surface to urge the stringer against the conveyor surface, while the engagement abutter is in its extended configuration and the stringer is carried along the narrow travel path by the conveyor surface, and a retracted configuration in which the engagement abutter is positioned a second distance from the conveyor surface that is greater than the first distance, and an actuator operative for moving the engagement abutter between the engagement abutter's extended and retracted configurations; and a controller operative for determining if the stringer is in a position proximate the engagement abutter, wherein the actuator of the engagement mechanism is responsive to the controller to:

move the engagement abutter to its retracted configuration while the stringer is remote from the engagement abutter, and move the engagement abutter to its extended configuration while the stringer is proximate the engagement abutter.

9. A coating machine for applying a coating material to a stringer according to claim 8, wherein the applicator mechanism comprises:

an applicator positioned downstream from the engagement abutter, a reservoir capable of containing the coating material, and an actuator operative for discharging the coating material from the reservoir so that the applicator is capable of applying the coating material to a side of the stringer that is generally opposite from the conveyor surface while the stringer is carried along the narrow travel path by the conveyor surface.

10. A coating machine for applying a coating material to a stringer according to claim 1, wherein:

the applicator mechanism comprises:

an applicator capable of being positioned at a predetermined position proximate the narrow travel path, a reservoir capable of containing the coating material, and an actuator operative for providing:

a discharge mode during which a first volumetric flow rate of the coating material is discharged from the reservoir so that the applicator is capable of applying the coating material to the stringer while the conveyor surface carries the stringer along the narrow travel path, and a retention mode during which any volumetric flow rate of the coating material that is discharged from the reservoir is substantially less than the first volumetric flow rate; and the coating machine further comprises a controller operative for determining if the stringer is proximate the predetermined position, wherein the actuator of the applicator mechanism is responsive to the controller to:

provide the discharge mode while the stringer is proximate the predetermined position, and provide the retention mode while the stringer is distant from the predetermined position.

11. A coating machine for applying a coating material to a stringer according to claim 10, wherein the motor is responsive to the controller to:

drive the conveyor surface at a first speed while the stringer is proximate the predetermined position, and drive the conveyor surface at a second speed that is slower than the first speed while the stringer is distant from the predetermined position, whereby the speed at which the conveyor surface travels during the discharge mode is greater than the speed at which the conveyor surface travels during the retention mode.

12. A coating machine for applying a coating material to a stringer according to claim 10, wherein:

the applicator is movable between:

an extended configuration, wherein the applicator is positioned proximate the narrow travel path and is a first distance from the conveyor surface during the extended configuration, and the applicator is capable of abutting a side of the stringer that is generally opposite from the conveyor surface to apply coating material to the stringer while the stringer is carried by the conveyor surface along the narrow travel path and the applicator is in its extended configuration, and a retracted configuration in which the applicator is positioned a second distance from the conveyor surface that is greater than the first distance, and the applicator assembly further comprises a second actuator operative for moving the applicator between its extended and retracted configurations, wherein the second actuator is responsive to the controller to:

move the applicator to its retracted configuration while the stringer is remote from the predetermined position, and move the applicator to its extended configuration while the stringer is proximate the predetermined position.

13. A coating machine for applying a coating material to a stringer according to claim 10, wherein:

the actuator of the applicator mechanism comprises a partition and a chamber, wherein the partition is positioned between the reservoir and the chamber, and the partition is capable of moving relative to the reservoir and the chamber in response to a pressure differential between the chamber and the reservoir;

the controller is operative to:

provide the discharge mode by supplying a pressurized medium to the chamber so that a first differential pressure is defined between the chamber and the reservoir, wherein the first differential pressure is characterized by the pressure within the chamber being greater than the pressure within the reservoir, and provide the retention mode by discharging the pressurized medium from the chamber so that any differential pressure characterized by the pressure within the chamber being greater than the pressure within the reservoir is less than the first differential pressure.

14. A coating machine for applying a coating material to a stringer according to claim 13, wherein the controller is operative to provide the retention mode by creating a vacuum in the chamber.

* * * * *